US007046953B2

(12) United States Patent
Hata et al.

(10) Patent No.: US 7,046,953 B2
(45) Date of Patent: May 16, 2006

(54) IMAGE FORMATION APPARATUS EQUIPPED WITH AUTOMATIC DOCUMENT FEEDER

(75) Inventors: Kiyoshi Hata, Hachioji (JP); Tsuyoshi Mizubata, Hachioji (JP); Masashi Aoki, Hachioji (JP); Satoru Shimizu, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 44 days.

(21) Appl. No.: 10/941,217

(22) Filed: Sep. 15, 2004

(65) Prior Publication Data

US 2005/0169681 A1 Aug. 4, 2005

(30) Foreign Application Priority Data

Feb. 4, 2004 (JP) ..... 2004-027759

(51) Int. Cl.
*G03G 15/00* (2006.01)
*G03G 21/00* (2006.01)

(52) U.S. Cl. ..... 399/367; 399/361; 399/363; 399/365; 399/370; 399/376; 399/383; 399/389

(58) Field of Classification Search ..... 399/367, 399/361, 363, 365, 370, 376, 383, 389
See application file for complete search history.

(56) References Cited

U.S. PATENT DOCUMENTS 6,081,687 A * 6/2000 Munemori et al. ..... 399/374
6,636,703 B1 * 10/2003 Deen et al. ..... 399/17
6,640,082 B1 * 10/2003 Mitomi ..... 399/374

FOREIGN PATENT DOCUMENTS

JP 08-272161 10/1996

* cited by examiner

*Primary Examiner*—Stephen Meier
*Assistant Examiner*—Marvin P. Crenshaw
(74) *Attorney, Agent, or Firm*—Cohen, Pontani, Lieberman & Pavane

(57) ABSTRACT

In an image forming apparatus having a document feeder for taking up a document from a document bundle placed on a document tray, a controller has a normal mode to perform a normal-size conveyance control by taking up each document from a bundle of documents having the same size, a multi-size mode to perform a multi-size conveyance control by taking up each document from a bundle of documents having various sizes. When the normal mode is carried out, the controller controls to stop the document after the first preset time passes after the trailing edge of the document has been detected, and when multi-size mode is carried out, the controller controls in place of using the first preset time by the second preset time which is set to be a longer time than the first preset time.

9 Claims, 3 Drawing Sheets

IMAGE FORMATION APPARATUS EQUIPPED WITH AUTOMATIC DOCUMENT FEEDER

BACKGROUND OF THE INVENTION

The invention relates to an image forming apparatus such as copier, printer, facsimile, scanner, and the like that can reads image information on documents. More particularly, the invention relates to an image forming apparatus equipped with an automatic document feeder that can take up each document from a document bundle placed on a document tray and reads image information of the document by a reading means.

Recently various information-processing technologies have made a rapid advance. Such technologies are a technology for photo-electrically reading image information (such as characters, numerals, symbols or pictures, drawings, and photos) on documents, a technology for storing a lot of read information, converting it into, for example, digital data, and storing it in a storing means such as memory, and a technology for transferring and reproducing digital data by mans of a transmission. These technologies have enabled image forming apparatus such as copier, printer, facsimile, scanner, and the like to process a lot of document image information very fast. Consequently, such image forming apparatus have been requested to handle much more documents.

Generally, an automatic document feeder (ADF) is often used to read a lot of documents.

The automatic document feeder has a document tray, a document conveyance device containing a plurality of rollers, and a control circuit that controls the operation of the document conveyance device to pick up each document from a document bundle placed on the document tray, automatically convey the document to a reading means of the image forming apparatus, and enable the reading means to easily read image information on one or both sides of the document.

In the automatic document feeder, a single document is taken up from the document bundle placed on the document tray by a document feeding means such as a take-up roller and transferred to the reading position of the reading means in the image forming apparatus through a long document path by a document conveyance device composed of a pair of rollers such as registration rollers and feed rollers. In this document conveyance, the document may be inclined from the direction of the normal document conveyance. This phenomenon is called a "document skew."

Such a large document skew may cause a paper jam in the document path of the automatic document feeder or may break the document due to document fold.

Conventionally, the automatic document feeder corrects a document skew by detecting the document path by sensors provided along the document transfer path, for example, by measuring a document conveyance time, controlling the operation of the document conveyance having a plurality of motors and rollers, and hitting the leading edge of the document to the peripheral surfaces of the rollers which have been stopped. (For example, see Patent Document 1: Japanese Non-examined Patent Publication No. Hei 08-272161.)

However, the large amount of documents in a bundle may not always be of the same size. They may contain paper sheets of various sizes. The recent automatic document feeders have been demanded to handle document bundles containing a lot of paper sheets of various sizes.

If the above method disclosed by Patent Document 1 is used to convey documents without skews, the automatic document feeder must detect the conveyance status of documents of each size. For this purpose, the automatic document feeder must have a great many sensors to detect various document sizes and the control circuit must be complicated to finely control the operation of the document conveyance device having a plurality of motors and rollers by detection signals from such a great many sensors.

Such a complicated control makes the document conveyance device more complicated equipped with additional sensors and motors. This increases the production cost of the automatic document feeder and makes it expensive. Naturally, the image forming apparatus with an automatic document feeder cannot be inexpensive.

SUMMARY OF THE INVENTION

Judging from the above, an object of the invention is to provide an image forming apparatus equipped with a simple, without generating skews, and inexpensive automatic document feeder.

The above object of the invention can be achieved by any one of the structures (1) to (9) below.

(1) An image forming apparatus equipped with an automatic document feeder, comprising a document feeding means for taking up a single document from a document bundle placed on the document tray, a first conveyance means for conveying the document from the document feeding means to a conveyance path in the downstream side, a second conveyance means for receiving the document from the first conveyance means and conveying the document to a conveyance path in the further downstream side, a document sensor which is provided in a conveyance path between the first conveyance means and the second conveyance means and to detect the trailing edge of the document, and a control means for repeatedly performing a conveyance control to convey the document from the document tray by driving the document feeding means, the first conveyance means and the second conveyance means. The control means has a normal mode to perform a normal conveyance control to control the conveyance control by taking up each document from a bundle of documents of the same size, and a multi-size mode to control multi-size conveyance control by taking up each document from a bundle of documents of various sizes. When the normal mode is carried out, the controller controls to stop the document after the first preset time passes after the trailing edge of the document has been detected, and when multi-size mode is carried out, the controller controls in place of the first preset time by the second preset time which is set to be a longer time than the first preset time.

(2) The image forming apparatus of structure (1), wherein the control means performs the conveyance control to stop the document at a position in the vicinity of downstream of the second conveyance means.

(3) The image forming apparatus of structure (1), wherein the control means performs the conveyance control to stop the document in a state in which the document is not interposed by the second conveyance means.

(4) The image forming apparatus of structure (1), wherein the second preset time is longer than the first preset time at least by a time period corresponding to a distance for which the document is conveyed, when the trailing edge of the document is inclined to the conveyance direction due to a document skew.

(5) The image forming apparatus of structure (1), wherein the second preset time is always fixed independently of the combinations of sizes of documents placed on the document tray.

(6) The image forming apparatus of structure (1), wherein the second preset time is fixed according to the combinations of sizes of documents placed on the document tray.

(7) The image forming apparatus of structure (1), wherein the document sensor is provided in the vicinity of the second conveyance means.

(8) The image forming apparatus of structure (1), further comprising a driving means having a drive source for driving the document feeding means and the first conveyance means in the first rotary direction of the drive source, and driving the second conveyance means in the second rotary direction opposite the first rotary direction.

(9) The image forming apparatus of structure (8), wherein the control means drives the document feeding means and the first conveyance means to start the document conveyance by operating the drive source in the first rotary direction, thereafter successively drives the second conveyance means by operating the drive source in the second rotary direction, stops the drive source after the first preset time or the second preset time passes after the trailing edge of the document is detected by the document sensor, and then controls to convey the document to a further downstream conveyance path.

In the multi-size mode, after the second preset time passes after the trailing edge of the document is detected by the document sensor, the control means of the invention stops the conveyance of the document, and then conveys the document to the document path provided further downstream. Therefore, the automatic document feeder of the invention can feed documents even having different sizes without causing any skewed document to stop in the second conveyance means while being pinched in the second conveyance means and without causing a large amount of document skew and resulting in document jam. Therefore, the invention can provide an image forming apparatus equipped with a simple, without skew, and inexpensive automatic document feeder.

Particularly, the second preset time is added at least by a time period corresponding to a distance for which the document is conveyed, when the trailing edge of the document is inclined to the conveyance direction. This can prevent the document from stopping in the rollers while being pinched, and can further suppress a large amount of document skew and a resulting paper jam in the downstream side of the document path.

Further, as the use of a fixed second time period can simplify controlling of document feeding, the invention can provide a cheap control circuit.

Furthermore, as the second preset time can be determined according to the combinations of document sizes in use, the image forming apparatus with the automatic document feeder can eliminate wasteful time and accomplish a higher productive image formation.

DETAILED DESCRIPTION OF THE PREFERRED EMBODIMENTS

Embodiments of the present invention will now be detailed with reference to accompanying drawings where the same reference marks in each of the drawings indicate the same elements. However, it should be understood that the invention is not limited to these embodiments.

Figure 1:
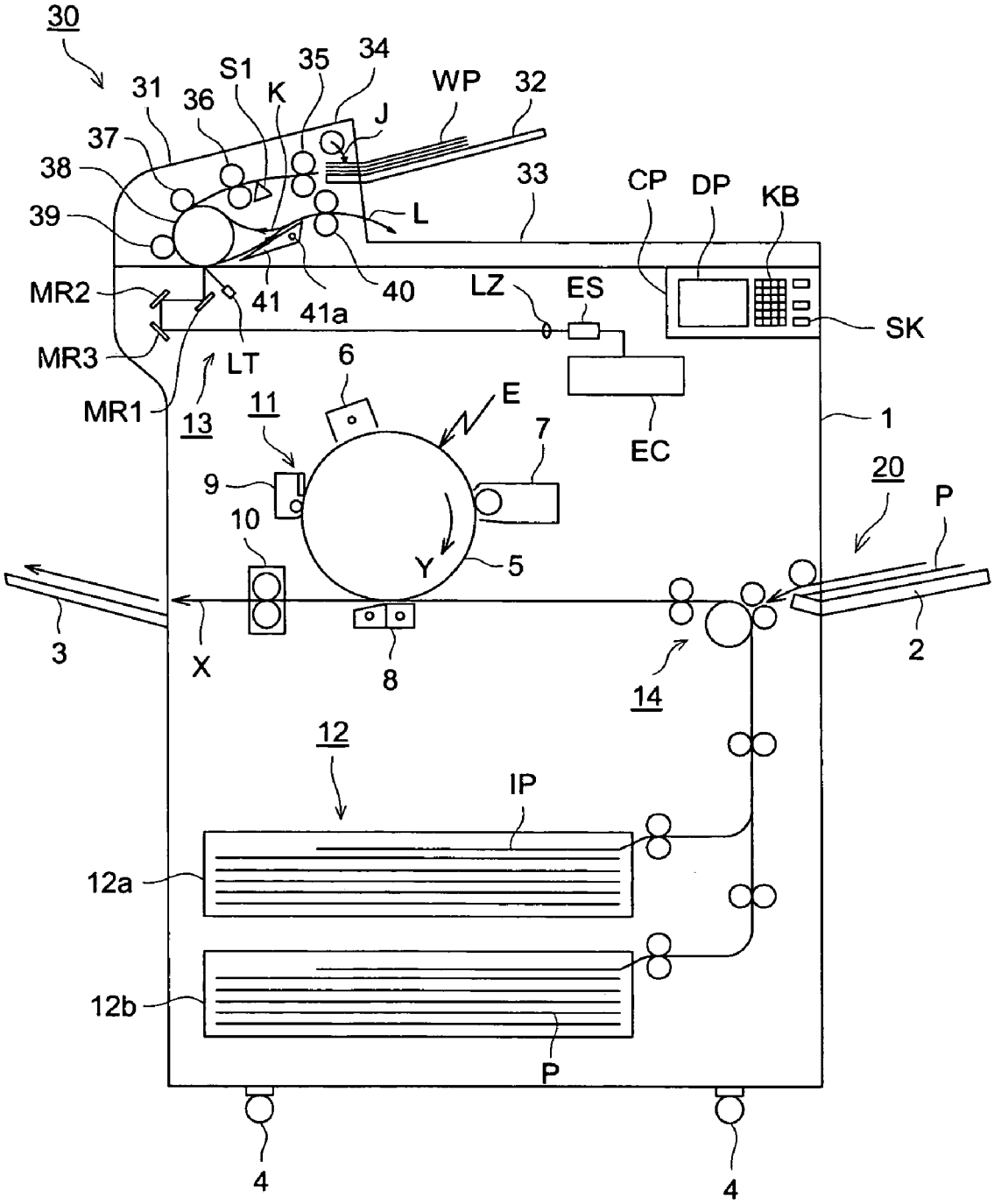
FIG. 1 is a schematic view of the image forming apparatus with an automatic document feeder of the invention.
Figure 2:
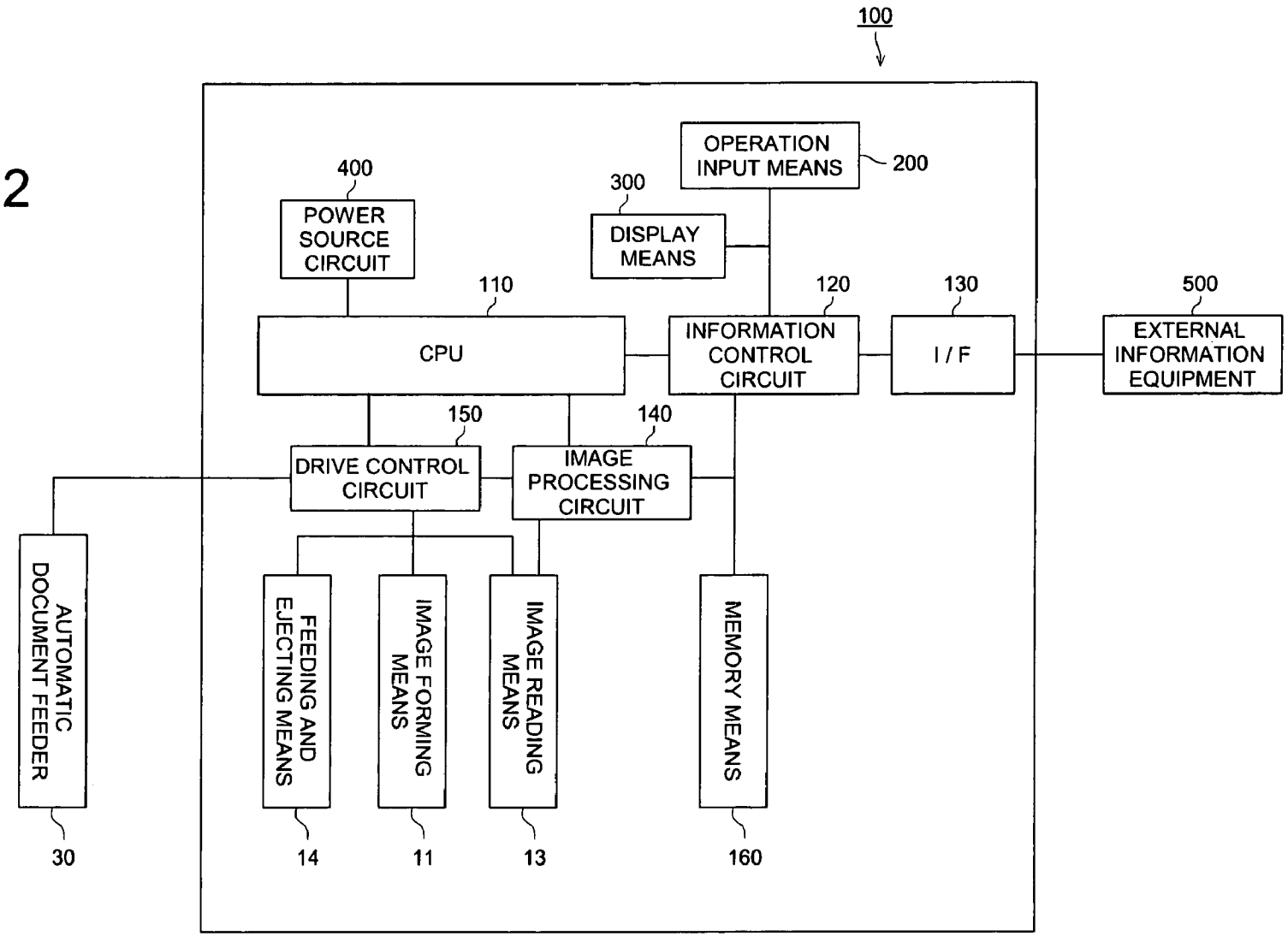
FIG. 2 is a functional block diagram of the circuitry of the image forming apparatus with an automatic document feeder of the invention.
Figure 3:
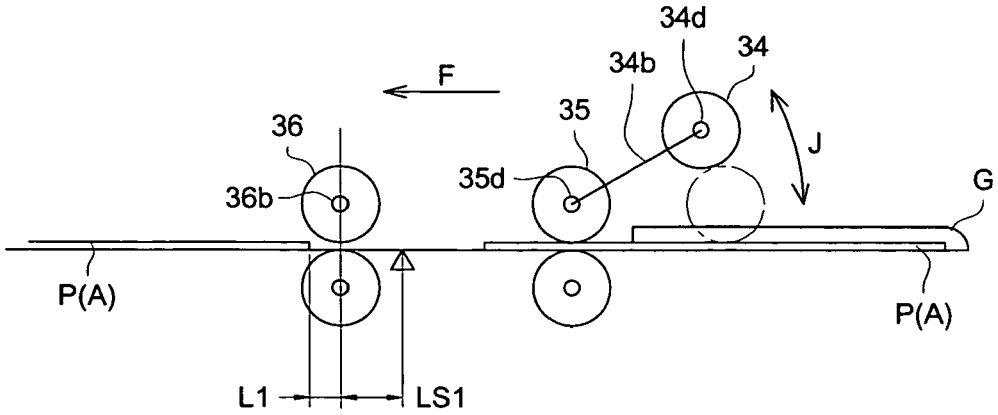
FIG. 3(*a*) and FIG. 3(*b*) are typical diagrams indicating document conveyance control of the automatic document feeder of the invention.
Figure 3:
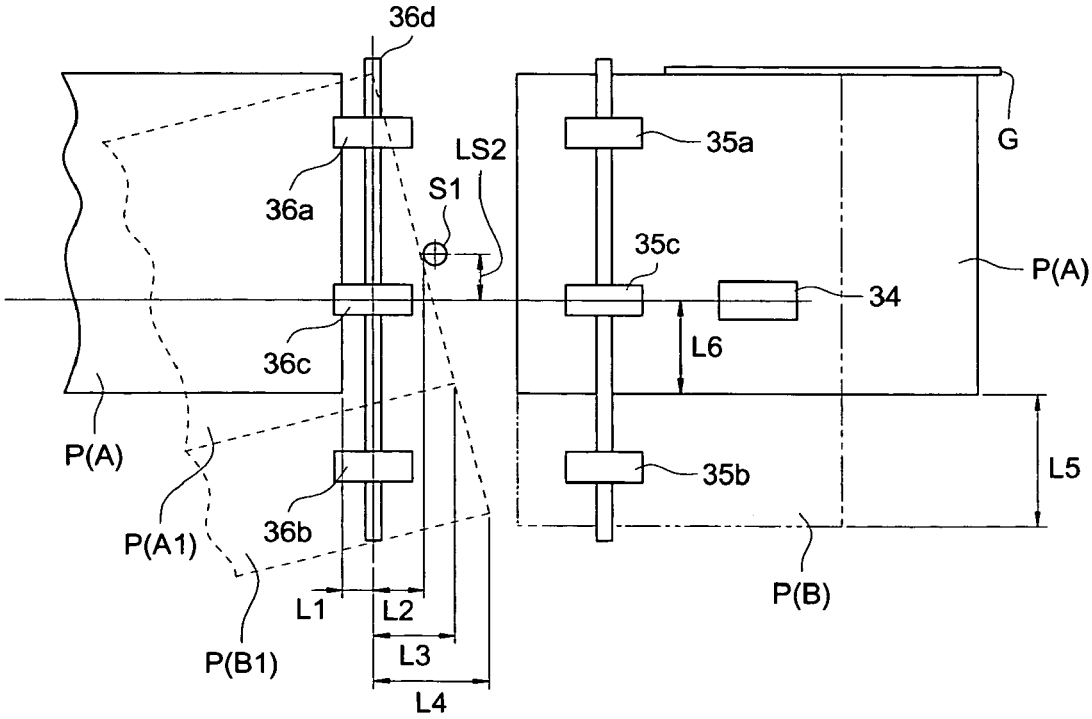

FIG. 1 is a schematic view of the image forming apparatus with an automatic document feeder of the invention. FIG. 2 is a functional block diagram of the circuitry of the image forming apparatus with an automatic document feeder of the invention. FIG. 3(*a*) and FIG. 3(*b*) are typical diagrams indicating document conveyance control of the automatic document feeder of the invention.

Below will be explained the configuration of an image forming apparatus related to the invention with reference to FIG. 1. For ease of explanation, the image forming apparatus of this embodiment assumes to be an electrophotographic copying machine. As this type of copying machine is well known, portions which are not directly related to the invention will be explained briefly.

The numeral 20 indicates the whole image forming apparatus. The main frame 1 of the image forming apparatus 20 has a manual feeding tray 2 on the right side on which a small amount of paper or transparent sheets is placed as normal transfer materials (transfer paper or plain paper) P to be fed.

On the left side, the main frame 1 has a receiving tray 3 that receives regular transfer materials P or special transfer material (such as index sheets used to form images according to index document) IP from the main frame after image formation.

The main frame 1 has a control panel CP that works as a displaying and operating means to operate the image forming apparatus 20 on the upper front part of the main frame 1.

The control panel CP is provided with a liquid crystal display means DP such as a LCD unit or a display means having a touch-sensitive panel on the display unit, and an input means which is composed of a keyboard KB to enter values or the like, a start button (or COPY button) to start a series of image forming operation such as copying, and the other components.

The main frame 1 has casters 4 on the bottom of the main frame to move the image forming apparatus 20.

Inside the main frame 1 provided are a control means EC, an image forming means 11, an image reading means 13, and a feeding and ejecting means 14.

The control means EC which is also called a control circuit for controlling all operations of the image forming apparatus 20. The control means EC is an electric circuit made up with a CPU (to be explained later) and other components. The control means EC is designed to drive and control all means in the image forming apparatus by a control program and control data preinstalled in the CPU.

The image forming means 11 forms an image according to image information of a document. For example, the image forming means 11 has a photosensitive drum 5 that is driven to rotate in a preset image forming direction (of arrow Y) by a driving source such as a motor, a charging means 6 that gives an even electric charge to the surface of the photosensitive drum 5, exposure light E that is turned into signals according to the image information (or image data) of the document and forms an electrostatic image on the surface of the photosensitive drum 5, a developing means 7 that makes the electrostatic image visible as a toner image on the surface of the photosensitive drum 5, a transferring and separating means 8 that transfers the toner image from the surface of the photosensitive-drum 5 to a transfer material P or the like, a cleaning means 9 that scrapes off remained toner and paper dust from the surface of the photosensitive drum 5 after the image is transferred, and a fixing means 10 that fuses and fixes the transferred toner image to the transfer material.

The fixing means is a heat roller type thermal fixing means that uses a fixing roller heated by a heat source (heater) and a pressure roller in contact therewith to interpose and convey a transfer material by these rollers and fix the toner image by heat and pressure during the conveyance.

When the image forming apparatus 20 is a copying machine, the reading device ES reads image information from a document placed on the platen glass (not shown in the drawing) or a document that is sent to the reading position by the automatic document feeder 30, converts the image information into digital image data, and stores the digital image data in a memory means 160 (to be explained later).

When reading a document fed by the automatic document feeder (ADF) 30, the image reading means 13 causes the light source LT to illuminate the document at the reading position, collects the lights reflected on the document by mirrors MR1, MR2, and MR3, focuses the light to the CCD surface of the reading device ES by an imaging lens LZ, receives image information from the CCD, and stores it as the image data.

The feeding and ejecting means 14 is a paper-transferring device composed of a paper feed cassette 12, a driving source such as a motor (not shown in the drawing), and a plurality of rollers.

The paper feed cassette 12 is composed of a cassette 12*a* for particular transferring materials IP (such as index sheets) and a cassette 12*b* for plain paper sheets P.

The paper transferring device selects a particular transferring material IP or plain paper sheet P according to the document in response to an instruction from the control means EC, drives the motor and rollers to transfer the plain paper P or particular transfer material IP from the paper feed cassette 12 towards the photosensitive drum 5 at an optimum timing, and sends the paper P or the material IP towards the receiving tray 3 after an image is formed on the paper P or the material IP.

The automatic document feeder (ADF) 30 on the top of the main frame 1 works in cooperation with the image reading mean 13 of the image forming apparatus 20 to automatically send a document to the reading position of the reading device ES and causes the reading device ES to read image information from the document.

The automatic document feeder (ADF) 30 is wholly covered with an ADF casing 31. The document tray 32 and the document stacker 33 are provided outside the ADF casing 31.

A bundle of documents WP is placed on the document tray 32 with the document side (front surface) of the first page faced up on the top of the bundle. Each document WP on the document tray is sent to the reading position by the document conveyance means, read by the reading device ES, and ejected to the document stacker 33.

Even when the bundle of documents WP has an index document on the top, the documents are fed, read, and ejected in the similar manner.

An index document is a thick paper sheet with a projection called a tab and usually describes a summary of the contents of the document bundle.

The document feeder is controlled by a driving control circuit (not shown in the drawing) to work in cooperation with the control means EC of the image forming apparatus 20.

The document feeder is composed of a take-up roller 34 that swings in the arrow direction J to take out each document WP from the document bundle on the document tray 32, feed rollers (A) 35 that convey the taken-up document to the downstream document path, a pair of feed rollers (B) 35 which is also called registration rollers, for example, stop the conveyed document WP temporarily and convey it at an optimum timing, a conveyance roller (C) 37 opposite the driven roller 38 that is driven to rotate with the document WP between the rollers 37 and 38, a reading roller 39 that holds and conveys the document WP together with the roller 38 to the reading position of the reading device ES to read it, a pair of ejection rollers 40 that send the read document WP in the direction of L to eject it, a reversing member 41 that turns and conveys the read document in the direction of K to read image information on the other side of the document WP, and a document sensor S1 that detects the document WP and outputs document detection information.

Particularly, to simplify the driving mechanism of the document feeding device, the embodiment of the invention uses as a motor as a means to drive the take-up roller 34 (as a feeding means), the conveyance roller (A) 35 as the first document conveyance means and the conveyance roller (B) 36 as the second document conveyance means. For example, the driving mechanism drives and rotates the take-up roller 34 and the conveyance roller (A) 35 in the first rotational direction (forward) and the conveyance roller (B) 36 in the second rotational direction (backward).

These rollers or a mechanism to transmit a driving force to these rollers are constructed for example to stop the conveyance roller (B) 36 when the motor runs forward and both the take-up roller 34 and the conveyance roller (A) 35 when the motor runs backward if a clutch mechanism is provided and a driving attempt is made to turn them in the opposite direction.

The document sensor S1 is made of a photo sensor and a mechanical switch and provided in the upstream side of the conveyance roller (B) 36 between the conveyance rollers (A) 35 and (B) 36.

The control means switches rotational directions of the motor to drive the conveyance rollers by information (signals) output from the document sensor S1 that the trailing edge of each of document in the conveyance direction is detected by the document sensor S1 and the conveyance of the document WP is complete, and obtains conveyance information to control the conveyance of the next document WP and to count information about the number of documents (or the number of pages) that were conveyed.

When the information from the document sensor 1 is used as count information, the information is sent to a memory means 160 through an information control circuit 120 and stored therein. When the information from the document sensor 1 is used as conveyance information, the information is sent to a drive control circuit 150 through the information control circuit 120. This information is used to start and stop the motor and change its rotational directions.

There are two conveyance modes: single side mode to read image information of only one side of a document WP and double side mode to read image information of both sides of a document WP. The reversing member 41 capable of swinging around the axis 41*a* changes the modes. The details of the reversing member 41 are not explained here.

The circuitry of the image forming apparatus of the invention will be explained below referring to FIG. 2.

The block 100 shows means and circuits in the whole image forming apparatus 20. The CPU 110 controls the operation of the whole image forming apparatus 20 and pre-installs programs for various modes to control the image forming apparatus 20 and data required to execute the programs.

An information control circuit 120, an image processing circuit 140, a drive control circuit 150, and a power supply circuit 400 are connected to the CPU 110. These circuits build up a control means EC to control the whole image forming apparatus 20.

When the image forming apparatus is equipped with a automatic document feeder 30, the control device EC also works as means to control the whole image formation system having the image forming apparatus 20 as the center to work smoothly in cooperation with the control circuit (not shown in this drawing) of the automatic document feeder 30.

The information control circuit 120 is connected to an external information equipment 500 through an interface (I/F) 130. In response to an instruction from the CPU 110, this control circuit 120 inputs image information (for example, characters and images) and setting information such as density and magnification required for image formation as a JOB which is a print unit, stores it in the memory means 160. The setting information stored in the storage means is output to the image processing circuit 140, the drive control circuit 150, or the display means 300.

The information control circuit 120 has a function of transmitting JOB information (entered from the external information equipment 500) and its accompanying data (JOB data) automatically and smoothly to respective circuits and means in the image forming apparatus to run the image forming apparatus normally. Such information contains input and output information such as instruction information concerning detailed control to operate circuits and means such as the image processing circuit 140 and the drive control circuit 150 and various kinds of information concerning image formation modes and types of transfer materials entered from the operation input circuit 200.

The external information equipment 500 is typically a personal computer or an Internet server. In some cases, it can be the other image forming apparatus on a local area network (LAN) or an information device such as a digital camera and a measuring instrument that can output information of measurement.

The interface (I/F) 130 is an information transferring means that interfaces the information control circuit to external information equipment 500 such as the above-explained personal computer, other image forming apparatus, and Internet server through networks.

The operation input means 200 is composed of an input means which has a keyboard KB and buttons such as a START button on a control panel CP of the image forming apparatus 20 and a touch-sensitive panel liquid crystal display unit DP which works as an input unit and a display unit.

For example, the operator can enter information such as the type and number of transfer materials (for example, index sheets, thick paper, thin paper, recycled paper, transparent sheets, and reused paper) or setting information such as a magnification of enlargement and reduction and an output image density by the keyboard KB and further the operator can set various operation modes of the image forming apparatus 20 by the liquid crystal display unit DP.

The display means 300 displays a list of operating procedures and information to enter various information from the operation input means 200, information stored in the memory means 160, running status of the image forming apparatus, or warning messages.

The embodiment of the invention uses a touch-sensitive panel liquid crystal display unit DP that enables both input and display and the operator can mainly select and set a transfer material type, a storage location, and an image formation mode that is one of the operating modes of the image forming apparatus.

There are four image formation modes are provided: (1) copying single document sides onto single sides of transfer material, (2) copying single document sides onto double sides of transfer material, (3) copying double document sides onto single sides of transfer material, and (4) copying double document sides onto double sides of transfer material. The operator can select any of the buttons corresponding to the image formation buttons on the display.

Selectable transfer material types are plain paper, thick paper, thin paper, index paper, recycled paper, transparent sheets, and reused paper. Selectable storage locations of transfer materials are a paper feed cassette 12 and a manual paper feed tray 2.

The image processing circuit 140 digitally converts document image information read by the image reading means 13 in response to an instruction from the CPU 110 and stores the resulting data as image data in the memory means 160. Further, this circuit 140 converts image data stored in the memory means 160 to data or signals fit for the image formation mode of the image forming means 11 when the image forming means 11 forms an image.

In response to instructions from the CPU 110, the drive control circuit 150 controls to operate the image forming means 11, the image reading means 13, the feeding and ejecting means 14, and the ADF 30 at optimum timing to form an image.

The memory means 160 stores JOB information that contains image data required for image formation and setting conditions to control the image forming apparatus 20, JOB data, and information concerning programs for various operating modes.

In the embodiment of the invention, JOB information and JOB data are defined as follows:

For example when the image forming apparatus 20 is a copying machine, JOB information means information concerning individual JOBs such as setting a document, selecting a single side mode or double side mode, selecting a paper feed cassette, selecting a copy count, selecting a print density, etc. namely a series of print data which is determined when an output setting is made and the start button is pressed. One JOB is a set of print data corresponding to one print instruction (also called "one print unit").

Similarly, when the image forming apparatus 20 is a printer, JOB information is a set of print data sent from an external information equipment 500. One JOB unit is to handle JOB information and JOB data for each JOB.

JOB data means data related to the setting of a transfer speed fit for the transfer material or data of control values related to detailed control items required to execute image formation.

The memory means 160 stores JOB information and JOB data for each JOB or JOB unit (simply as a JOB unit).

As shown in FIG. 1, the image forming means 11 is composed of a photosensitive drum 5, a charging means 6, a developing means 7, a transfer separating means 8, a cleaning means 9, and a fixing means 10 and operated by the drive control circuit 150.

In details, the image forming means 11 is controlled by image data which is read by the image reading means 13 and stored in the memory means 160, JOB information, and JOB data to form an image on the surface of the photosensitive drum 5, and transfers the image from the photosensitive drum 5 to the plain paper P or particular transfer material IP.

As shown in FIG. 1, the image reading means 13 is composed of a reading optical system and a reading apparatus ES. This means 13 is driven by the drive control circuit 150 to read the image information of a document at the reading position by the reading apparatus ES, convert the read image information to digital image data for example by the image processing circuit 140, and store it in the memory means 160.

As shown in FIG. 1, the feeding and ejecting means 14 is composed a cassette section 12 that stores particular transfer materials IP and plain paper P and a feeding and ejecting device.

After a particular transfer material IP or plain paper P is selected in response to an instruction from the CPU 110, the feeding and ejecting device is driven by the drive control circuit 150 to send the particular transfer material IP or plain paper P selected from the cassette 12 to the photosensitive drum 5 at an optimum timing, change the conveyance path of the printed IP or P according to the single side mode or the double side mode, and finally eject the IP or P to the paper stacker 3.

The automatic document feeder (ADF) 30 is equipped, for example, with an ADF control circuit (not shown in the drawing), automatically takes up each document from the document tray 32, and feeds it to the reading position by the document feeding device. The automatic document feeder (ADF) 30 works in cooperation with the drive control circuit in response to an instruction from the CPU 110.

When the start button SK is pressed on the image forming apparatus 20, the document feeding device is driven by the drive control circuit 150 and works according to the preset program.

Further in response to the conveyance information output from the document sensor S1, the driving mechanism runs the motor forward or backward as already explained to drive the rollers to take up each document WP from the document bundle on the document tray and send it to the reading position of the image forming apparatus 20.

The power supply circuit 400 supplies optimum power to the whole image forming apparatus when the operator turns on the power switch (not shown in the drawing) and shuts off power when the operator turns off the power switch.

However, in the power saving mode to keep the image forming apparatus in the standby status even when the power switch is turned on, the CPU 110 instructs to supply only power required to back up the content of temporary memory and shut off power to the heater of the fixing means and others.

Below will be explained how the conveyance control is made in the automatic document feeder of the invention referring to FIG. 3(*a*) and FIG. 3(*b*). FIG. 3(*a*) is a side view of the major part of the automatic document feeder and FIG. 3(*b*) is a plane view of the major part of the automatic document feeder.

In FIG. 3(*a*), numeral 34 is a take-up roller and numeral 35 is a pair of feed rollers (A) 35. Numeral 36 is a pair of feed rollers (B) 36. Numerals 34*d*, 35*d*, and 36*d* are respective shafts of rollers. This roller mechanism are driven and controlled by a driving means by a driving means made of a driving force transmission mechanism such as a motor which is a driving source not shown in the drawing, gears, and belts.

Particularly, the take-up roller 34 (document feeding means) can move up and down in the direction of J around the rotary shaft 35*d* by an arm member 34*b* which is provided between the rotary shaft 34*d* and the rotary shaft 35*d* of the conveyance roller (A) 35. When taking up one document P (A) from a document bundle positioned correctly long the document guide G on the document tray 32, the take-up roller 34 moves down (in the clockwise direction of J), touches the top document P (A) on the document bundle WP, and rotates to take up and feed the document in the direction of F.

The conveyance rollers (A) 35 (the first conveyance means) catch a single document P (A) sent from the take-up roller 34, and convey it towards the conveyance rollers (B) 36 (the second conveyance means). The conveyance rollers (B) 36 catch the document P (A) sent from the conveyance rollers (A) 35, and convey it through the downstream conveyance path towards the reading position of the image forming apparatus.

The document sensor S1 is provided in the upstream side of the conveyance path by a distance of LS1 away from the center of the conveyance roller (B) 36. When detecting the trailing edge of a document P (A) sent from the conveyance rollers (B) 36, the sensor S1 outputs conveyance information to the control circuit EC to stop the motor of the driving means a preset time later so that the trailing edge of the document P (A) may reach a downstream position by a distance L1 away from the conveyance rollers (B) 36, namely so that the document P (A) may stop after passing through the conveyance rollers (B) 36, and restart the motor to convey the next document P (A).

As will hereinafter be described in detail, the embodiment of the invention is constructed to rotate the take-up roller 34, the conveyance rollers (A) 35, and the conveyance rollers (B) 36 forward and backward by a single motor. For example, the take-up roller 34 and the conveyance rollers (A) 35 are driven to rotate in the forward direction (or simply forward) and the conveyance rollers (B) 36 are driven to rotate in the backward direction (or simply backward). Naturally, the forward and backward directions are determined adequately when the driving force transmission mechanism is built up.

Below will be briefly explained the normal document feeding of the automatic document feeder. The "normal document feeding" means taking up and feeding each document from a bundle of documents of the same size. The mode for implementing this operation is called a normal mode.

When the operator places documents P correctly along the side of the document guide on the document tray 32 and presses the START button SK on the image forming apparatus 20, the information control circuit detects information concerning depression of the start button SK and starts the CPU 110. The CPU 110 causes the drive control circuit 150 to operate the control circuit (not shown in the drawing) of the image forming apparatus.

The control circuit of the automatic document feeder runs the motor forward to rotate the take-up roller 34 and the conveyance rollers (A) 35 and take up one document P (A) from the document WP on the document tray 32.

When the leading edge of the document P (A) comes to a position at which the rollers (B) 36 catch the document P (A), the control circuit stops the motor and runs the motor in the reverse direction to rotate the rollers (B) 36. When detecting the trailing edge of the document P (A) that is fed by the rollers (B) 36, the document sensor outputs conveyance information. A preset time after receiving the conveyance information, the control circuit of the automatic document feeder stops the motor.

In this status, the document P (A) stops at the downstream position L1 with its trailing edge released from the rollers (B) 36. In this configuration, the document P (A) never stops between the rollers (B) 36.

In this status, the leading edge of the document P (A) (not shown in this drawing) remains caught by the conveyance roller (C) 37 and the roller 38. The driving force transmission mechanism consisting of the same or another motor drives the conveyance roller 37, the roller 38, the read roller 39, the ejection roller 40, and the reversing member 41 to read and convey the document P (A).

The above conveyance steps are repeated to run the motor forward and backward and accomplish the series of conveyance operation.

As already explained, these rollers or the driving force transmission mechanism that transmits a driving force to the rollers are respectively equipped with a one-way clutch so that they can be operated by a single motor. For example, the rollers (B) 36 stops while the motor runs forward. The take-up roller 34 and the rollers (A) 35 stop while the motor runs backward.

Although the document sensor S1 in this embodiment is designed to be used only for detecting the trailing edge of a document P (A), outputting conveyance information, and stopping the reverse rotation of the motor, it is also possible to make the document sensor S1 control the motor by detecting the leading edge of a document P (A) and outputting conveyance information. For example, when stopping the document P (A) at a position at which the leading edge of the document P (A) is caught by the rollers (B) 36 and changing the rotational direction of the motor, it is possible to stop the forward rotation of the motor by conveyance information which the document sensor S1 outputs when detecting the leading edge of the document P (A), run the motor in the reverse direction to cause the rollers (B) 36 to convey the document P (A), cause the document sensor S1 to output conveyance information when detecting the trailing edge of the document P (A), and stop the motor a preset time after receiving the conveyance information.

Next, will be briefly explained the document feeding of the automatic document feeder in the multi-size mode referring to FIG. 3(*b*). The document feeding in the multi-size mode means taking up and feeding each document from a bundle of documents of different sizes.

The automatic document feeder of this embodiment is assumed to have a multi-size mode for feeding each document from a bundle of documents of different sizes. As shown in FIG. 3(*b*), the automatic document feeder can feed a document P (B) indicated by a chain double-dashed line that is not equal in size to the document P (A). Namely, the document P (B) is longer by L5 than the document P (A) along the conveyance of the document (width perpendicular to the document P (A)). For example, when the document P (A) is an A4-size document placed longitudinally along the conveyance of the document, the document P (B) can be an A4R document placed landscape along the conveyance of the document or an A3-size document placed landscape along the conveyance of the document. However, it is to be understood that this embodiment is not limited to these document sizes.

To feed documents P(A) and P(B) of different sizes, the take-up roller 34 is provided so that it may touch the center of the document width perpendicular to the conveyance of the document P(B). The roller assembly (A) 35 consists of two rollers 35*a* and 35*b* on both ends of the rotary shaft 35*d* which is perpendicular to the conveyance of documents and a roller 35*c* which is equally spaced from the rollers 35*a* and 35*b* on the rotary shaft. Similarly, the roller assembly (B) 36 consists of two rollers 36*a* and 36*b* on both ends of the rotary shaft 36*d* which is perpendicular to the conveyance of documents and a roller 36*c* which is equally spaced from the rollers 36*a* and 36*b* on the rotary shaft.

In this configuration, all rollers are used to convey a document P (B). However when a document P (A) is conveyed, there is a distance of L6 between the center of the roller 35*c* and the nearby edge of the document. When a document P (A) is conveyed in the state of FIG. 3(*b*), the rollers 35*b* and 36*d* are not substantially in charge of document conveyance. Therefore, it is assumed that the document P (A) is more apt to cause a document skew than the document P (B).

Some documents have punched binding holes in the center of the documents. To prevent wrong edge detection by these holes, the document sensor S1 is provided by a distance of LS1 upstream from the shaft of the roller assembly (B) 36 and by a distance of LS2 from the center of the width perpendicular to the conveyance of the document.

As explained above, there has been problem that, in the case of the multi-size mode, document skews tend to easily occur, since each roller is different in its contact position with each of documents having different sizes during conveyance of the documents.

For example, when a document guide is provided on one side of the document tray and particularly when a document P (A) is taken up and fed by the take-up roller 34, a document skew indicated by a dotted line P (A1) in FIG. 3(B) may occur due to the contact status of the rollers and the document. In this document skew, one corner of the document is in the axial center of the rotary axis 36*d* of the conveyance rollers (B) 36 and the other corner is by a distance of L3 away from the center of the shaft.

Similarly when a document P (B) is conveyed, a document skew indicated by a dotted line P (B1) in FIG. 3(B)) may occur due to the contact status of the rollers and the document. In this document skew, one corner of the document is in the axial center of the rotary shaft 36*d* of the conveyance rollers (B) 36 and the other corner is by a distance of L4 away from the axial center.

However, when this skewed document P (A1) or P (B1) is conveyed, the document sensor S1 detects the skewed trailing edge of the document and outputs conveyance information assuming that the document sensor detects the trailing edge of the document which passes in the normal state.

In other words, when the motor stops a preset time for normal document conveyance (first time) required to transfer the document by a distance which is the sum of the trailing edge position L1 of the document and the leading edge L2 of the detection area of the document sensor S1 after the conveyance information is output from the document sensor S1 after the document sensor detects the trailing edge of the document, the skewed trailing edge of the document P (A1) or P (B1) is not in the L1 position and part of the skewed trailing edge may remain caught in the pair of conveyance rollers (B) 36.

If the next document conveyance operation starts and the rollers (B) 36 start to rotate while the skewed trailing edge of the document P (A1) or P (B1) remains pinched in the conveyance rollers (B) 36, the pinched document may be skewed further as it receives an excessive rotational force from the rollers (B) 36 or as the pinched part of the document may receive a great resistance when the conveyance roller (C) 37 starts to convey the document.

In the above description, the time between the detection of the leading edge by the document sensor S1 and the stop of the motor is set, for example, to a time period (the first time) required to convey the document P (A1) by a distance of L1 and L2 without a skew. Contrarily, there is set the time to a time period (the second time) required to convey the document by a distance of L1 and L3 when conveying a document P (A1) or a time period (the third time) required to convey the document by a distance of L1 and L4 when conveying a document P (B1). Namely there is made the first time longer by a time period required to convey the document by a distance equivalent to a difference between L3 or L 4 and L2, which is equivalent to an additional distance made by a document skew.

For example, we tested the document feeding of the automatic document feeder under the conditions of the following: rollers (B) 36 of 20 mm in diameter, L1=5 mm, and LS1=15 mm, document feed speed (line speed)=400 mm/sec, first time required to feed a document by a distance of L1 and L2 (20 mm) at this line speed=50 msec, second time in the similar condition=75 msec (sum of the first time and 25 msec), third time=100 msec (sum of the first time and 50 msec), and a ADF control circuit using a commercially-available photo sensor as the document sensor S1. The first, second, and third time periods are determined a little longer assuming inclinations of documents relative to the document widths: A4-size document placed longitudinally along the conveyance of the document (1 time), A4R document placed landscape along the conveyance of the document (approx. 1.5 times) and A3-size document placed landscape along the conveyance of the document (approx. 2 times).

As the result, even when a document skew occurs between the rollers (A) 35 and (B) 36, the automatic document feeder of the invention could convey documents successfully without stopping the motor without holding the trailing edge of the document in the rollers (B) 36 and by correcting the document skew by the roller (C) 37 and the succeeding rollers.

Judging from the result of this test, we used, as the first preset time in the normal mode, a time period required to convey the document by a distance of L1 and L3, namely, the second time for the document P (A1) to suppress a great document skew even when the document is skewed a little. In the multi-size mode, judging from that a document skew is apt to occur because the documents have different sizes, we used, as the second preset time, a time period, required to convey a document by a distance of L1 and L4 for the document P (B1), which seems to be a little longer. The second preset time is slightly longer than that of the first preset time.

Although the embodiment of the invention uses a fixed value which is a little greater as the second preset time independently of document sizes in use for simple and steady conveyance control to reduce the production cost of the controller. It is possible to prepare some sets of data values for combinations of document sizes in use, store them in a form of a table in the memory means 160, and select a desired document size combination from the table for example by using the operation input means 200 on the control panel CP of the image forming apparatus 20 or the touch-sensitive display panel on the display means 300 to set the second preset time. This can eliminate the wasteful time and improve the productivity of image formation.

As described above, the embodiment of the invention can provide an image forming apparatus equipped with a simple, skewless, and inexpensive automatic document feeder without any additional mechanism for example by storing a first preset time for document conveyance in the normal mode and second preset times for document conveyance in the multi-size mode in the memory means 160 and using a selected second preset time instead of the first preset time to carry out document conveyance in the multi-size mode.

Further this embodiment can prevent a document from remaining pinched in the rollers by adding a time period required to convey the document by an additional distance made by skewing to the second preset time and further can prevent a greater downstream document skew that causes a paper jam.

As the structure, function, and performance of the automatic document feed are dependent on machine types, it is preferable to set the first and second preset times specific to respective automatic document feeders by actually testing under various document sizes available in the multi-size mode and document skew conditions.

Further, as the automatic document feeders have different operating times because of dispersions in production, it is preferable that each automatic document feeder has a function to adjust its own preset time.

What is claimed is:

1. An image forming apparatus having an automatic document feeder, comprising:

(a) a document feeder for taking up a document from a document bundle placed on a document tray;

(b) a first conveyance device for conveying the document from the document feeder to a conveyance path on a downstream side;

(c) a second conveyance device for receiving the document from the first conveyance device and conveying the document to a conveyance path on a further downstream side;

(d) a document sensor provided in a conveyance path between the first conveyance device and the second conveyance device for detecting a trailing edge of the document; and (e) a controller for repeatedly performing a conveyance control to convey the document from the document tray by driving the document feeder, the first conveyance device and the second conveyance device, wherein the controller has a normal mode to perform a normal-size conveyance control by taking up each document from a bundle of documents having the same size, and a multi-size mode to perform a multi-size conveyance control by taking up each document from a bundle of documents having various sizes, and wherein the normal mode is carried out, the controller controls to stop the document after a first preset time passes after a trailing edge of the document has been detected, and when the multi-size mode is carried out, the controller controls in place of using the first preset time by a second preset time which is set to be a longer time than the first preset time.

2. The image forming apparatus of claim 1, wherein the controller controls to stop the document at a position in the vicinity of downstream of the second conveyance device.

3. The image forming apparatus of claim 1, wherein the controller controls to stop the document in a state in which the document is not interposed by the second conveyance device.

4. The image forming apparatus of claim 1, wherein the second preset time is longer than the first preset time at least by a time period corresponding to a distance for which the document is conveyed, when the trailing edge of the document is inclined to a conveyance direction due to a document skew.

5. The image forming apparatus of claim 1, wherein the second preset time is always fixed independent of a combination of sizes of documents placed on the document tray.

6. The image forming apparatus of claim 1, wherein the second preset time is fixed according to a combination of sizes of documents placed on the document tray.

7. The image forming apparatus of claim 1, wherein the document sensor is provided in the vicinity of the second conveyance device.

8. The image forming apparatus of claim 1, further comprising a driver having a drive source for driving the document feeder and the first conveyance device in a first rotary direction of the drive source, and driving the second conveyance device in a second rotary direction opposite to the first rotary direction.

9. The image forming apparatus of claim 8, wherein the controller drives the document feeder and the first conveyance device to start the document conveyance by operating the drive source in the first rotary direction, thereafter successively drives the second conveyance device by operating the drive source in the second rotary direction, stops the drive source after the first preset time or the second preset time passes after the trailing edge of the document is detected by the document sensor, and then controls to convey the document to a further downstream conveyance path.

* * * * *